US010342256B2

(12) United States Patent
Carretta

(10) Patent No.: US 10,342,256 B2
(45) Date of Patent: Jul. 9, 2019

(54) CIGARETTE CUTTER

(71) Applicant: Thomas Carretta, Ocean, NJ (US)

(72) Inventor: Thomas Carretta, Ocean, NJ (US)

( * ) Notice: Subject to any disclaimer, the term of this patent is extended or adjusted under 35 U.S.C. 154(b) by 0 days.

(21) Appl. No.: 15/193,672

(22) Filed: Jun. 27, 2016

(65) Prior Publication Data

US 2017/0196258 A1 Jul. 13, 2017

Related U.S. Application Data

(60) Provisional application No. 62/387,960, filed on Jan. 11, 2016.

(51) Int. Cl.
*A24F 13/24* (2006.01)
*A24F 13/20* (2006.01)

(52) U.S. Cl.
CPC ..... *A24F 13/24* (2013.01); *A24F 13/20* (2013.01)

(58) Field of Classification Search
CPC ..... A24F 13/20; A24F 13/24; A24F 13/26
See application file for complete search history.

(56) References Cited

U.S. PATENT DOCUMENTS 293,665 A * 2/1884 Myers ..... A24F 13/24 30/109
318,995 A * 6/1885 Lilly ..... A24F 13/24 30/109
351,886 A * 11/1886 Pohl ..... A24F 13/24 144/167
553,030 A * 1/1896 Higgins ..... A24F 13/24 131/251
962,481 A * 6/1910 Walker ..... A24F 13/24 30/109
1,048,402 A * 12/1912 Ford et al. ..... A24F 13/24 131/233
1,256,636 A * 2/1918 Ambrose ..... A24F 13/24 131/233

(Continued)

FOREIGN PATENT DOCUMENTS

DE 2950351 A1 * 6/1981 ..... A24F 13/24
GB 190920036 A * 12/1909 ..... A24F 13/24

*Primary Examiner* — Seyed Masoud Malekzadeh
*Assistant Examiner* — Taryn Trace Willett
(74) *Attorney, Agent, or Firm* — Thomas Hayes

(57) ABSTRACT

The invention relates to a cigarette cutter for cutting cigarettes. The cigarette cutter includes a housing assembly with a base portion and sidewall portion surrounding the base portion that together form a cavity wherein the base portion is coupled to a spring assembly and the spring assembly is coupled to a plunger assembly through a guide rail. The plunger assembly includes a base plate coupled to a cutter assembly that includes a blade that extends a distance from the base of the plunger assembly. In addition, formed along the sidewall portion is an aperture and coupled with the aperture is a cigarette receiving plate for receiving a cigarette and the receiving plate includes a groove or slot that runs vertical to the cigarette. The plunger when compressed extends the blade through the aperture and through the cigarette and to the bottom of the groove or through the slot so as to provide a clean cigarette cut. Once the plunger is released, the recoil of the spring assembly causes the plunge assembly to return to its normal position.

9 Claims, 2 Drawing Sheets

(56) References Cited

U.S. PATENT DOCUMENTS

| | | | | | |
|---|---|---|---|---|---|
| 1,538,522 | A * | 5/1925 | Spinner | A24F 13/24 | 131/248 |
| 4,027,682 | A * | 6/1977 | Halmaghi | A24F 13/24 | 131/233 |
| 4,160,318 | A * | 7/1979 | Morel | A24F 13/24 | 131/248 |
| 4,231,378 | A * | 11/1980 | Stevens | A24F 13/24 | 131/253 |
| 5,836,318 | A * | 11/1998 | Adams | A24F 13/24 | 131/253 |
| 5,992,022 | A * | 11/1999 | Carrera Moya | A24F 13/24 | 131/248 |
| 6,049,984 | A * | 4/2000 | McGehee | A24F 13/24 | 131/248 |
| 7,409,955 | B2 * | 8/2008 | Mauldin | A24F 13/20 | 131/233 |
| 8,485,200 | B1 * | 7/2013 | Levinger | A24F 47/00 | 131/248 |
| 2009/0211589 | A1 * | 8/2009 | Smith | A24F 13/26 | 131/328 |
| 2012/0211014 | A1 * | 8/2012 | Bardelli | A24F 13/24 | 131/250 |

* cited by examiner

CIGARETTE CUTTER

CROSS REFERENCE TO RELATED APPLICATION

This application claims priority to U.S. Provisional Patent Application No. 62/387,960 filed Jan. 11, 2016 and entitled "Cig Clip," the entire contents of which are hereby fully incorporated herein by reference.

TECHNICAL FIELD

The present invention relates to a cigarette cutter, more particularly to a cigarette cutter with a housing assembly, a spring assembly, a plunger assembly, a cutting assembly, and aperture and cigarette receiving plate for receiving cigarettes and cleanly cutting cigarettes.

BACKGROUND

With the public becoming fully aware of the dangers of smoking cigarettes, new industries have spawned to help smokers quit, e.g. e-cigarettes, over the counter nicotine flavored chewing gum, doctor prescribed medication, and self-help programs. Regardless, people are likely to smoke cigarettes and are likely to smoke cigarettes for the foreseeable future. People are likely to continue to smoke and people are likely to continue to try and quit. Simply put, people that smoke like tobacco and enjoy tobacco but understand the hazards and, as such, are usually trying to quit or cutback. As such, people that don't rely on themselves to quit or the aforementioned examples, typically will try to cutback their smoking by limiting the number of cigarettes they smoke per day. What this typically involves is a smoker will light a cigarette, smoke a portion of it, and then put it out and either throw it away or save it for later. The problem with this is that the smoker in the former case wastes tobacco and in the latter case has to carry around snuffed out cigarette that for most is not desirable.

There is a need for cigarette accessory that a smoker can easily carry and make better use of unfinished cigarettes. More specifically, if the smoker were provided with an apparatus that could cleanly preserve unfinished cigarettes without damaging the cigarette and could cleanly discard tobacco refuse from the cigarette, the smoker could be better served by helping the smoker reduce the amount he or she smokes and by saving money.

SUMMARY

The present invention is directed to a cigarette cutter which provides a compact, inexpensive, and efficient technique for cutting cigarettes.

According to this invention, a cigarette cutter comprises a housing assembly that includes a base bottom portion and an upstanding side wall portion surrounding and continuing the base bottom portion to form a cavity that includes an internal base receiving plate formed along a circumference of the upstanding sidewall portion. The housing assembly further includes a spring assembly with spring attached to the base receiving plate and a guide rail coupled to a section of the upstanding side wall portion and extending along a portion of the upstanding side wall portion to a center of the cavity and above the spring.

According to this invention, the cigarette cutter further comprises a first and second aperture formed along a wall of the upstanding side wall portion and with the first and second aperture equidistantly spaced from each other. The housing assembly further includes a cigarette receiving plate connecting the first and second aperture and further including a groove formed across a vertical of the cigarette receiving plate.

According to this invention, the cigarette cutter further includes a plunger assembly wherein the plunger assembly includes a plunger base plate with a first and second rod coupled to the plunger base plate and that extends from the plunger base plate to the spring through the guide rails and can extend and retract along the guide rail a distance proportional to the spring compression ratio. The plunger assembly further includes a cutting assembly coupled to the plunger base plate and that also includes a blade that extends a distance from the plunge base plate. The plunger assembly when compressed causes the blade to extend the maximum distance allowed by the spring through the aperture and to the groove of the cigarette receiving plate.

DETAILED DESCRIPTION OF THE PRESENTLY PREFERRED EMBODIMENTS

Figure 1:
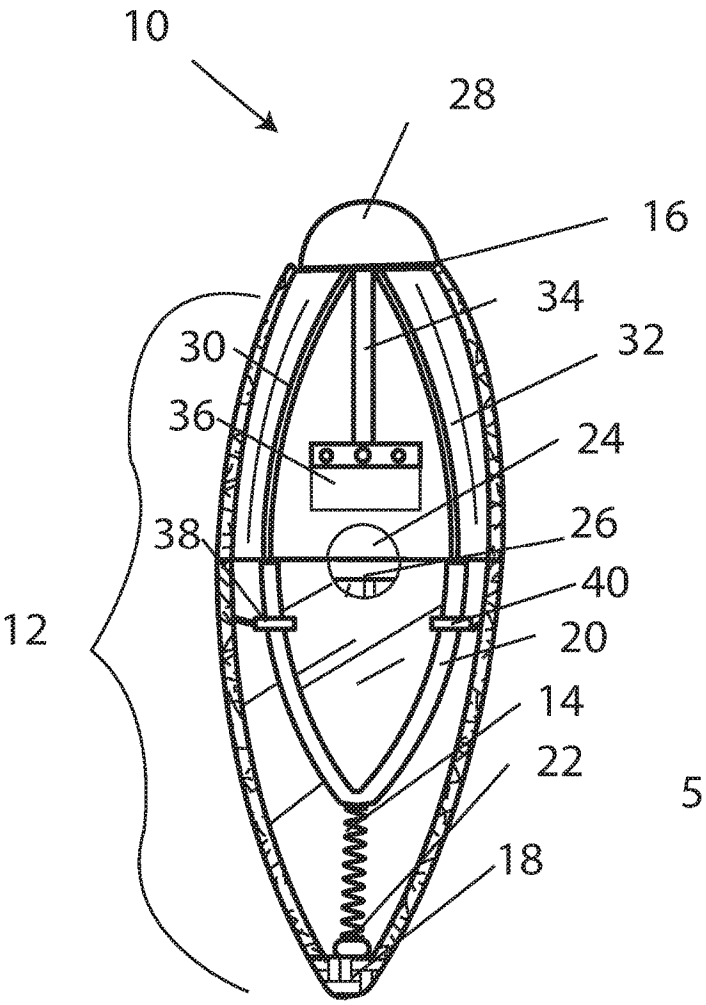
FIG. 1 is a cut-away side view of a cigarette cutter formed from a housing assembly with plunger assembly, and spring assembly.

Referring to FIG. 1, cigarette cutter 10 illustrates a compact, inexpensive, and effective assembled cigarette cutter from a cut-away side view. Cigarette cutter 10 includes a housing assembly, a spring assembly 14, and plunger assembly 16.

The housing assembly 12 includes a base bottom portion 18 and an upstanding side wall portion 20 surrounding and continuing the base bottom portion 18 to form a cavity that includes an internal base receiving plate 22 formed along a circumference of the upstanding sidewall portion 20. The spring assembly 14 coupled to the base receiving plate 22 includes a spring that extends a distance from the base receiving plate 22 to approximately a center area of the cavity. The sidewall portion 20 further includes an aperture 24 formed along the sidewall portion 20. The aperture 24 may be formed an approximate equidistant along the sidewall portion's length. Coupled with the aperture 24 or formed therewith includes a cigarette receiving plate 26. Although not illustrated in FIG. 1, the cigarette receiving plate 26 may include a vertical groove vertical to the length of a cigarette placed in the aperture for providing a cleaner cut. In addition, the cigarette receiving plate 26 may be coated with an aluminum alloy or other like materials to protect the body of the housing assembly from sustaining heat damage from lit cigarettes.

The plunger assembly 16 includes a plunger base plate 28, a first rod 30 and second rod 32 coupled to the base plate 28, and a cutter assembly 34 coupled to the base plate 28 that includes a blade 36 that extends a distance from the base plate 28. The first and second rod 30,32 extend from the base plate 28 through a first and second guide slot 38,40, although as another embodiment the guide could be guide rails, see FIG. 2 below, to the spring assembly 14. The first and second rod 30,32 couples with the spring assembly 14 and when the plunger base plate 28 is compressed extends the blade 36 from an initial position to the length of the available distance provided by the spring through the aperture 24. The blade 36 extends through the aperture all the way to the bottom of the groove formed in the cigarette receiving plate 26. The groove formed in the receiving plate 26 provides for a cleaner cut of the cigarette placed through aperture 24 and on the receiving plate 26.

Figure 2:
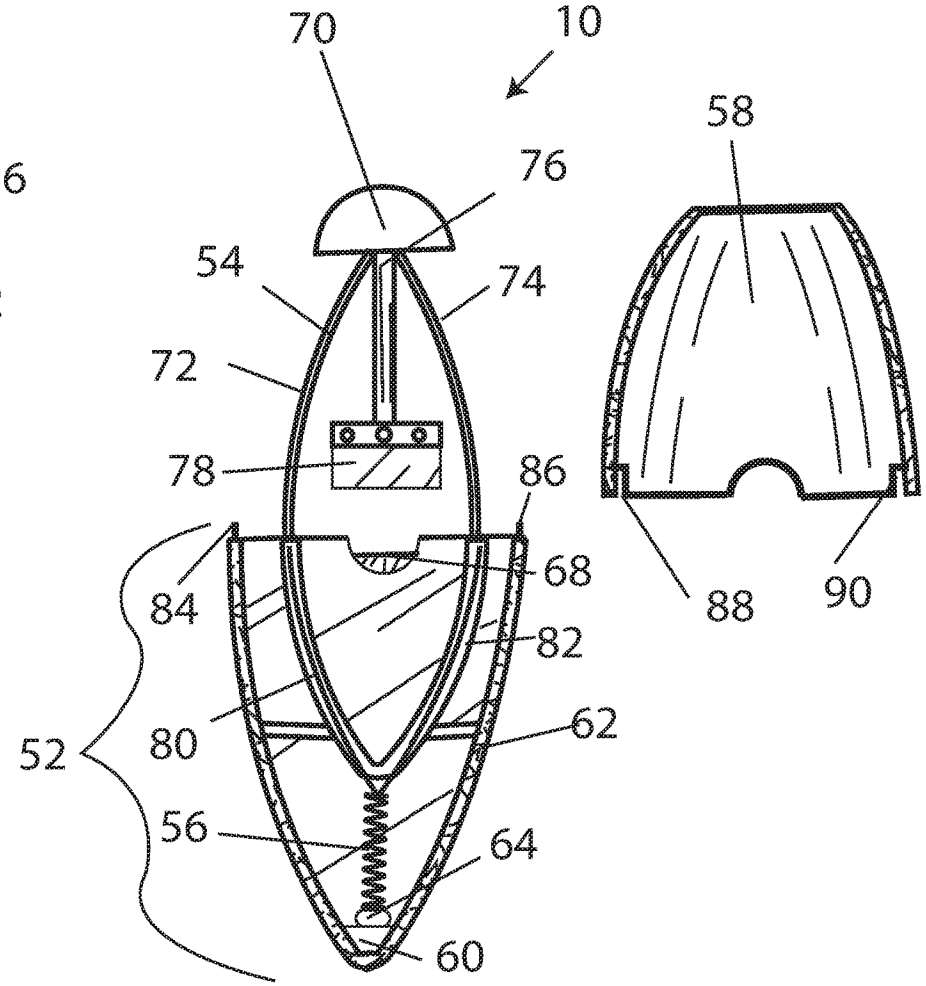
FIG. 2 is a cut-away side view of a base and top assembly of a cigarette cutter forming the housing assembly with plunger assembly, and spring assembly.

Referring now to FIG. 2, a disassembled cigarette cutter 50 is illustrated from a cut-away side view. Cigarette cutter 50 includes a lower housing assembly 52, a plunger assembly 54, a spring assembly 56, and an upper housing assembly 58 capable of being coupled to the lower housing assembly 52.

The lower housing assembly 52 includes a base bottom portion 60 and an upstanding side wall portion 62 surrounding and continuing the base bottom portion 60 to form a cavity that includes an internal base receiving plate 64 formed along a circumference of the upstanding sidewall portion 62. The spring assembly 56 coupled to the base receiving plate 64 includes a spring that extends a distance from the base receiving plate 64 to approximately a center area of the cavity. The sidewall portion 62 further includes a lower aperture 66 formed along the sidewall portion 62. The aperture 66 may be formed along the upper end of the sidewall portion's length. Coupled with the aperture 66 or formed therewith includes a cigarette receiving plate 68. Although not illustrated in FIG. 1, the cigarette receiving plate 26 may include a vertical groove vertical to the length of a cigarette placed in the aperture for providing a cleaner cut. Alternatively, the cigarette receiving plate 26 may include a slot. In addition, the cigarette receiving plate 26 may be coated with an aluminum alloy or other like materials to protect the body of the housing assembly from sustaining heat damage from lit cigarettes.

The plunger assembly 54 includes a plunger base plate 70, a first rod 72 and second rod 74 coupled to the base plate 70, and a cutting assembly 76 coupled to the base plate 70 that includes a blade 78 that extends a distance from the base plate 70. The first and second rod 72,74 extends from the base plate 70 through a first and second guide rail 80,82, although as another embodiment the guide could be a guide slots, as illustrated in FIG. 1, to the spring assembly 56. The first and second rod 72,74 couples with the spring assembly 56 and when the plunger base plate 70 is compressed extends the blade 78 from an initial position to the length of the available distance provided by the spring through the aperture 64 and recoil from the spring causes the blade 78 to return to the initial position. The blade 78 extends through the aperture 64 all the way to the bottom of the groove formed in the cigarette receiving plate 68. In the alternative embodiment, the blade 78 extends through the aperture 64 all the way through the slot. The groove or slot formed in the receiving plate 68 provides for a cleaner cut of the cigarette placed through aperture 64 and on the receiving plate 68. The difference between the groove and the slot is that the blade is stopped by the surface of the grooves channel whereas the slot allows the blade to cleanly traverse the slot until the spring fully stops the travel of the blade.

The lower housing assembly 52 further includes a first male insert 84 and a second male insert 86 formed along a rim of the lower housing assembly 52. The lower housing assembly 52 and the first and second male insert 84,86 could be formed from an plastic injection molding process. The first and second male insert includes a protruding, wide body member that when coupled with a female receptacle with a receiving member slightly of width less than the wide body member, the first and second male insert 84,86 couples with the female insert. I.e., it is the force of the tension of the insert against the receptacle that allows the the lower housing assembly and the upper housing assembly to couple. This may be accomplished, e.g., using injection plastic molding.

The upper housing assembly 58 includes an upper aperture and a first female receptacle and a second female receptacle 88,90 for receiving the first and second male insert 84,86 that when the upper housing assembly 58 and the lower housing assembly 52 are forced in contact along the path formed by the inserts and receptacle causes the upper and lower housing assembly 58,52 to couple in a secure way and provide an ingress and egress aperture for receiving a cigarette and discarding tobacco and ash remains. It should be understood, the male inserts and female receptacles may be switched so that the male inserts are formed on the upper housing assembly 58 and the female receptacles are formed on the lower housing assembly 52.

Figure 3:
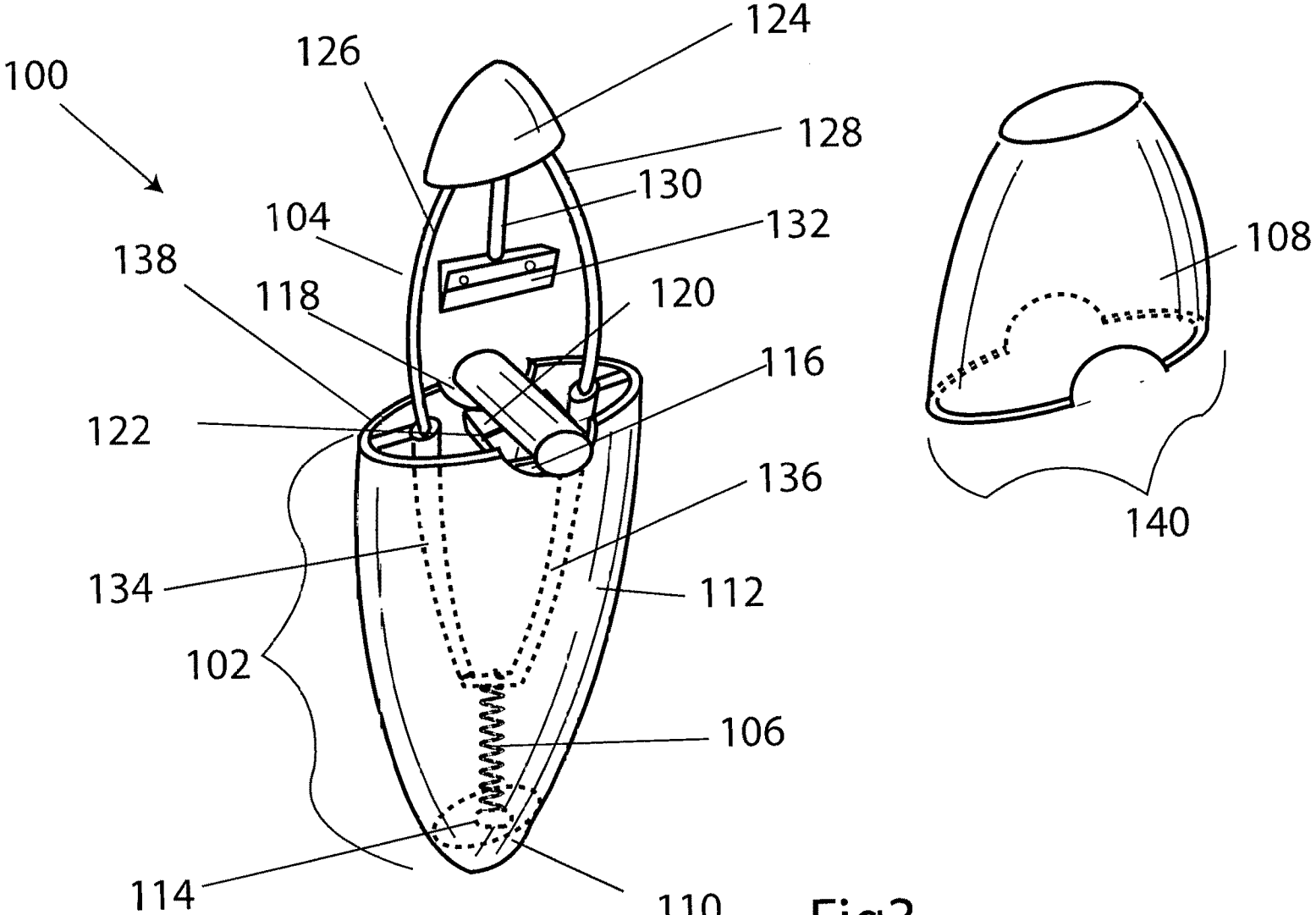
FIG. 3 is a perspective view of a cigarette cutter formed from a housing assembly with plunger assembly, and spring assembly.

Referring to FIG. 3, illustrated is a perspective view of a disassembled cigarette cutter 100. Cigarette cutter 100 includes a lower housing assembly 102, a plunger assembly 104, a spring assembly 106, and an upper housing assembly 108 capable of being coupled with the lower housing assembly.

The lower housing assembly 102 includes a base bottom portion 110 and an upstanding side wall portion 112 surrounding and continuing the base bottom portion 110 to form a cavity that includes an internal base receiving plate 114 formed along a circumference of the upstanding sidewall portion 112. The spring assembly 106 coupled to the base receiving plate 114 includes a spring that extends a distance from the base receiving plate 114 to approximately a center area of the cavity. The sidewall portion 112 further includes a first lower aperture 116 and a second lower aperture 118 formed along the sidewall portion 112 for receiving a cigarette. The first and second aperture 116,118 may be formed along the upper end of the sidewall portion's length and when the lower housing assembly 102 and the upper housing assembly 108 are coupled form an opening for receiving the cigarette. To add in the use of the cigarette cutter 100, the first and second aperture 116,118 may be of different size that would indicate to a user an ingress and egress. For example, when upper housing assembly 102 and lower housing assembly 102 are coupled the opening formed for receiving the cigarette may have one aperture opening significantly larger than the other. Coupled with the first aperture 116 and the second aperture 118 or formed therewith includes a cigarette receiving plate 120. The receiving plate 120 includes a groove 122 formed into the receiving plate 120.

Alternatively, the receiving plate may include a slot formed into the receiving plate 120. The receiving plate 120 may be either formed of an aluminum alloy or coated with the aluminum alloy in order to prevent heat conducting through or otherwise damaging cigarette cutter 100. It should also be understood, the receiving plate 120 may extend a distance around the circumference of the upper rim of the lower housing assembly 102 so as to prevent tobacco or ash for entering the cavity formed by the assembly 102. Alternatively, a sidewall may be formed with the receiving plate 120 to prevent tobacco or ash from entering the cavity formed by the assembly 102.

The plunger assembly 104 includes a plunger base plate 124, a first rod 126 and second rod 128 coupled to the base plate 124, and a cutting assembly 130 coupled to the base plate 124 that includes a blade 132 that extends a distance from the base plate 124. The first and second rod 126,128 extends from the base plate 124 through a first and second guide rail 134,136 to the spring assembly 106. The first and second rod 126,128 couples with the spring assembly 106 and when the plunger base plate 124 is compressed extends the blade 132 from an initial position to the length of the available distance provided by the spring through the aperture 116,118 and recoil from the spring causes the blade 78 to return to the initial position. The blade 130 extends through the center of the aperture 116,118 all the way to the bottom of the groove formed in the cigarette receiving plate 120. In the alternative embodiment, the blade 78 extends through the aperture 64 all the way through the slot. The groove or slot formed in the base receiving plate 120 provides for a cleaner cut of the cigarette placed through aperture 116,118 and on the receiving plate 120.

The lower housing assembly 52 further includes a female receptacle 138 formed along the rim of the lower housing assembly 102. The lower housing assembly 102 and female receptacle 138 may be formed from an plastic injection molding process, as an example. The female receptacle 138 includes a narrow cavity that when coupled with a male insert with an insert member slightly of greater width allows the insert and receptacle to couple in secure manager. I.e., it is the force of the tension of the insert against the receptacle that allows the the lower housing assembly and the upper housing assembly to couple. This may be accomplished, e.g., using injection plastic molding.

The upper housing assembly 108 includes an upper aperture and a male receptacle 140 formed along the rim of the upper housing assembly 108 that when the upper housing assembly 108 and the lower housing assembly 102 are forced in contact along along the rim causes the upper and lower housing assembly 108, 102 to couple in a secure way and create an ingress and egress opening for a cigarette. It should be understood, the male inserts and female receptacles may be switched so that the male inserts are formed on the lower housing assembly 102 and the female receptacles are formed on the upper housing assembly 108.

Although the upper and lower house assemblies described in FIGS. 1-3 discuss using a male and female insert and receptacle, it should be understood that the rim of the upper and lower house assemblies could be secured in other ways, e.g. using a thread formed along the rim of the upper and lower housing that would allow the upper and lower housing assemblies to be secured by screwing the assemblies together.

The lower and upper housing assemblies 102,108 may be formed using plastic injection molding manufacturing techniques. Alternatively, the lower and upper housing assemblies may be formed using aluminum alloys. Both techniques provide for assemblies that can be made inexpensively yet provide adequate durability. The first and second rod 126,128 may be also be made from plastic injection molding or possibly from metal.

Thus, While there have been shown and described and pointed out fundamental novel features of the invention as applied to a preferred embodiment thereof, it Will be under stood that various omissions and substitutions and changes in the form and details of the devices illustrated, and in their operation, may be made by those skilled in the art Without departing from the spirit of the invention. For example, it is expressly intended that all combinations of those elements and/or method steps Which perform substantially the same function in substantially the same Way to achieve the same results are Within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

The invention claimed is:

1. A cigarette cutter comprising:

a housing assembly that includes a base bottom portion and an upstanding side wall portion forming a cavity that includes an internal base receiving plate formed or coupled along a circumference of the cavity;

a spring assembly coupled to a center of the base receiving plate that includes a spring extending a vertical distance from the base receiving plate to a center of the cavity;

the sidewall portion further includes a first aperture and a second aperture formed along the sidewall portion with the first aperture formed an equidistant along a circumference of the sidewall portion from the second aperture; and a cigarette receiving plate coupled to the first aperture and the second aperture and extending from between the first aperture to the second aperture;

a plunger assembly includes a plunger base plate, a first rod and second rod coupled to the plunger base plate with each rod extending around the cigarette receiving plate and a cutter assembly coupled to the plunger base plate, between the first and second rod, that includes an extension rod coupled to a blade that extends a distance from the plunger base plate; and the first and second rod each extend from the plunger base plate through a first and second guide slot, the first and second guide slot coupled to the cavity, to the approximate center within the cavity and to the spring of the spring assembly;

the first and second rod coupled to the spring through the first and second guide slot and when the plunger base plate is compressed the blade moves from an original position to the length of the available distance provided by the spring, the blade extends between and through the first and second aperture to the cigarette receiving plate and upon release of the plunger base plate recoil from the spring causes the blade to return to the original position.

2. The cigarette cutter of claim 1 wherein the cigarette receiving plate includes a groove formed along a vertical of the receiving plate, vertical to a length of a cigarette placed on the cigarette receiving plate.

3. The cigarette cutter of claim 2 wherein the blade extends through the aperture all the way to the bottom of the groove formed along the vertical of the receiving plate.

4. The cigarette cutter of claim 1 wherein the cigarette receiving plate includes a slot formed along a vertical of the receiving plate.

5. The cigarette cutter of claim 4 wherein the blade extends all the way through the slot formed along the vertical of the receiving plate.

6. The cigarette cutter of claim 1 wherein the first and second aperture are formed an equidistant along the sidewall portion's length.

7. The cigarette cutter of claim 1 wherein the surface of the cigarette receiving plate includes a protective aluminum alloy coating.

8. The cigarette cutter of claim 1 wherein the cigarette receiving plate extends to the the upstanding side wall portion.

9. The cigarette cutter of claim 1 wherein the housing assembly is formed from plastic injection molding.

* * * * *